US006688505B1

(12) United States Patent
Bradley et al.

(10) Patent No.: US 6,688,505 B1
(45) Date of Patent: Feb. 10, 2004

(54) GLOVE BUDDY

(76) Inventors: Frank R. Bradley, 3060 N. Atlantic Ave., #109, Cocoa Beach, FL (US) 32931; John F. Caswell, Jr., 510 Goldenrod Ct., Lakeland, FL (US) 33813

( * ) Notice: Subject to any disclaimer, the term of this patent is extended or adjusted under 35 U.S.C. 154(b) by 150 days.

(21) Appl. No.: 09/963,043

(22) Filed: Sep. 25, 2001

Related U.S. Application Data

(60) Provisional application No. 60/275,776, filed on Mar. 14, 2001.

(51) Int. Cl.[7] ..... A45F 5/00

(52) U.S. Cl. ..... 224/230; 224/269; 224/918; 224/932; 224/933; 224/194; 473/406; 473/408

(58) Field of Search ..... 224/230, 269, 224/663, 666, 667, 918, 901.2, 901.8, 933, 932, 669, 194; 24/562; 473/406, 408

(56) References Cited

U.S. PATENT DOCUMENTS

| | | | | | |
|---|---|---|---|---|---|
| D191,787 | S | * | 11/1961 | Heil | 24/562 |
| 4,475,676 | A | * | 10/1984 | Smith | 224/269 |
| 4,530,500 | A | * | 7/1985 | Kaymen | 473/406 |
| 4,625,862 | A | | 12/1986 | Clayton | |
| 4,960,239 | A | * | 10/1990 | Wait | 473/406 |
| 5,143,371 | A | * | 9/1992 | Strahan | 224/269 |
| 5,186,373 | A | | 2/1993 | Taylor | |
| 5,305,999 | A | * | 4/1994 | Tate | 473/406 |
| 5,433,436 | A | * | 7/1995 | Hoyt et al. | 473/406 |
| 5,562,553 | A | * | 10/1996 | Digerness et al. | 473/408 |
| 5,795,248 | A | * | 8/1998 | Giglio | 473/406 |
| 5,864,925 | A | | 2/1999 | McGee | |
| 5,934,530 | A | | 8/1999 | Antczak et al. | |
| D416,134 | S | * | 11/1999 | Cloutier | D3/221 |
| 6,022,280 | A | * | 2/2000 | Arenburg et al. | 473/408 |
| 6,202,911 | B1 | | 3/2001 | Freer | |
| D453,294 | S | * | 2/2002 | Bitzer | D8/395 |

* cited by examiner

*Primary Examiner*—Nathan J. Newhouse
(74) *Attorney, Agent, or Firm*—Brian S. Steinberger; Law Offices of Brian S. Steinberger, P.A.

(57) ABSTRACT

A clip holder for supporting sports accessories such as gloves, and towels, for being attached to pockets and belts, for different types of sports such as but not limited to racquetball, handball, baseball, bowling, bicycling, football, and the like. The clip holder is compact with two plate like portions substantially parallel and adjacent to one another, with interior facing ridge and groove for allowing the clip holder to grip about pocket edges, belts and straps. The clip holder plates can have concave lower edges which face away from one another. A removable golf tool such as a tack shaped ball marker can attach to an exterior side of one of the plates. A built on tool such as a fork shaped divot repair tool can be fixably attached to or be part of one of the edges of the first and the second plates, and can be used with or without the removable golf tool. When not being used to support sports accessories, the compact clip holder can clip money bills together, and can be safely inserted inside one's pocket.

6 Claims, 5 Drawing Sheets

Fig. 9
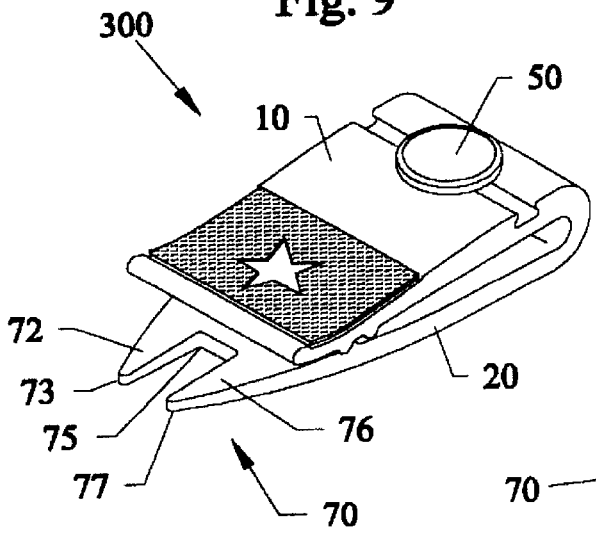
Fig. 10
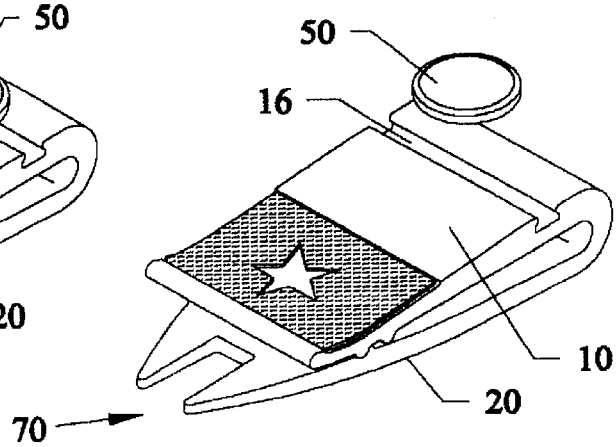
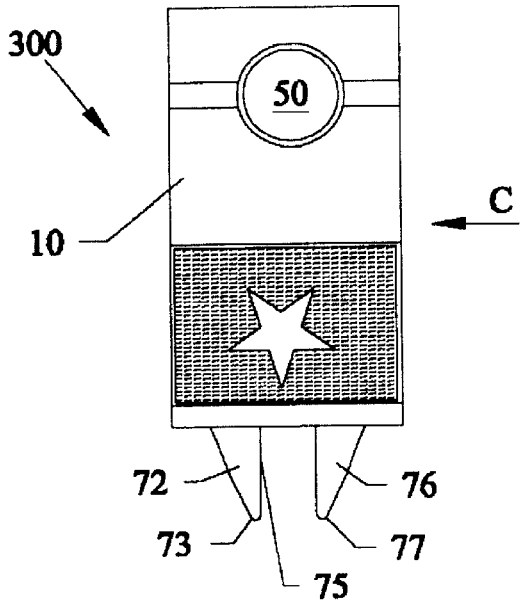
Fig. 11
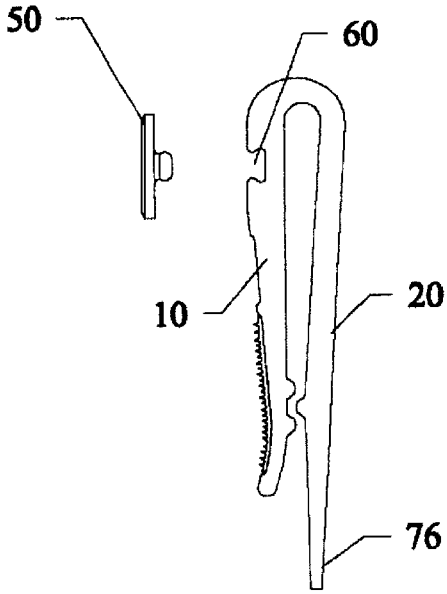
Fig. 12

GLOVE BUDDY

This invention relates to golf accessories, and in particular to a clip holder for supporting sports accessories such as golf gloves, onto pants pockets, belts and the like, and which the clip holder can also function as a ball marker slot and divot repair tool, and money clip, and this invention claims the benefit of U.S. Provisional Application No. 60/275,776 filed Mar. 14, 2001.

BACKGROUND AND PRIOR ART

Over the years accessories for golfers have increased. Accessories such as gloves, ball markers, and divot repair tools have become more common accessories to a golfer playing a course. Normally, golfers have tucked gloves into their pockets which has caused problems. Gloves tend to become dirty with use and can soil the clothing of the golfer. Additionally, the gloves can be wet from falling on the ground and further compound the problem of soiling the golfer's clothing. Finally, loosely fitting gloves into a rear pocket can end up with the glove falling out of the pocket and becoming lost. Thus, it is not desirable to stuff golf gloves, especially expensive leather golf gloves into one's pockets.

Other accessories such as ball markers and divot repair tools also end up being stuffed in one's pockets, and causing similar problems where these other accessories can soil clothing, puncture clothing, and further become lost over time by falling out of the pockets.

Other sports such as racquetball, bowling, handball, baseball, bicycling, football, and the like, also use gloves, and have similar problems as those described above.

The inventors are aware of several U.S. Patents that attempt to store gloves. See U.S. Pat. No. 4,625,862 to Clayton; U.S. Pat. No. 5,186,373 to Taylor; U.S. Pat. No. 5,864,925 to McGee and U.S. Pat. No. 5,934,530 to Antczak. However, these devices fail to store any other types of accessories. Furthermore, all of the patents cited above are generally too large and/or cumbersome and/or impractical to be stored entirely in a single pant's pocket. These devices could tear the fabric in a pant's pocket and even poke and injure the user. While Taylor appears to be the smallest device, this device requires the use of a magnet which can cause additional problems. For example, a magnet could easily demagnetize any credit cards and/or magnetic strip cards being carried in one's pocket by a golfer.

Two other patents attempt to store different accessories besides gloves. See U.S. Pat. No. 5,934,530 to Antczak et al. and U.S. Pat. No. 6,202,911 to Freer. However, these devices also appear to be large and cumbersome to use, as well as being unattractive eyesores when hanging from a golfer's pockets, and cannot be stored inside one's pocket. Additionally, other problems exist with these patents. For example, both Antczak and Freer allow for a divot tool to be separately attached to their device. This separate attached divot tool would be capable of easily falling off and becoming lost overtime.

Thus, the need exists for solutions to the above-cited problems in the prior art.

SUMMARY OF THE INVENTION

A primary object of the subject invention is to provide a simple, small and effective clip holder for temporarily holding accessories such as gloves onto a pants pocket or belt.

The secondary object of the subject invention is to provide a clip holder for attachment to a pants pocket or belt that can also be used as a divot repair tool and ball marker.

The third objective of the subject invention is to provide a clip holder for attaching gloves outside of a pocket or belt that has built on tools for other golf applications.

The fourth objective of the subject invention is to provide a clip holder for temporarily attaching golf accessories thereon, that when not used can also be used inside the pocket for other applications such as being used as a money type clip.

The fifth objective of the subject invention is to provide a clip holder for supporting sports accessories outside of a pocket or belt, The sixth objective of the subject invention is to provide a clip holder for supporting sports accessories that can simply and easily be inserted into a person's pocket without damaging (ripping, tearing, and the like) the person's pocket.

The seventh objective of the subject invention is to provide a clip holder for supporting sports accessories that can simply and easily be inserted into a person's pocket without sticking into and/or causing injury to the person.

Preferred embodiments of clip-device for golf accessories includes a first flange, a first fastener such as but not limited to hook and loop fasteners attached to an exterior portion of the first flange, a second flange, and a bent edge for attaching the first flange and to the second flange together in a substantially sandwich configuration to form a rigid clip, where golf accessories such as gloves, and towels having fasteners such as hook and loop fasteners can easily be attachable and detachable from the first fastener on the clip-device. The flanges can have rounded edges and lower concave exterior portions back to back to one another. On interior sides of the flanges can be gripping members that allow the clip-device to snugly and easily clip about planar materials, such as but not limited to pant's pockets, shirt pockets, belts, straps, and the like.

The flanges can include indicia engraved into and/or punched into a face portion of at least an exterior side of the first flange, and the second flange. The indicia can also be engraved into and/or punched into the exterior-facing fastener on the clip-device. A second embodiment allows for golf tools such a ball marker to be easily attachable and detachable to one of the flanges. For example, a stem portion of a ball marker can slide into a groove on one of the flanges, or snap into a slot on one of the flanges.

A third embodiment can include a tool, such as but not limited to a divot repair tool built into an edge of one of the flanges. The built-in tool can be used with or without the removable tool.

The invention can have additional utility such as being used as a money clip, and the like.

Further objects and advantages of this invention will be apparent from the following detailed description of a presently preferred embodiment which is illustrated schematically in the accompanying drawings.

BRIEF DESCRIPTION OF THE FIGURES

FIG. 9 is a perspective view of a third embodiment of the clip holder having a built on golf tool with a ball marker.

FIG. 10 shows the clip holder of claim 9 with the ball marker separated from the clip holder.

FIG. 11 is a front view of the clip holder of FIGS. 9–10.

FIG. 12 is a side view of the clip holder of FIG. 11 along arrow C.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
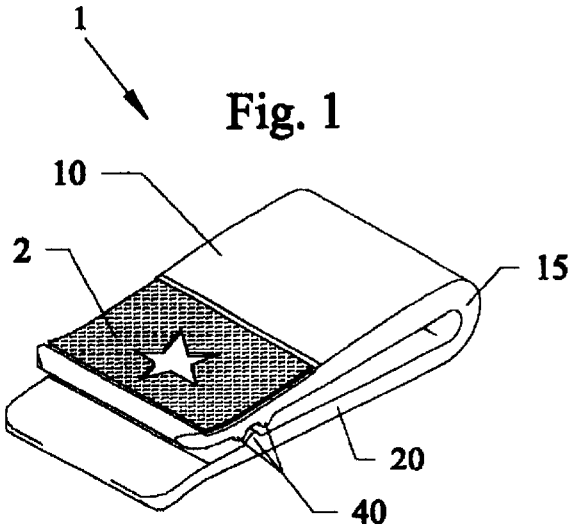
FIG. 1 is a perspective view of a first embodiment of the novel clip holder device.
Figure 2:
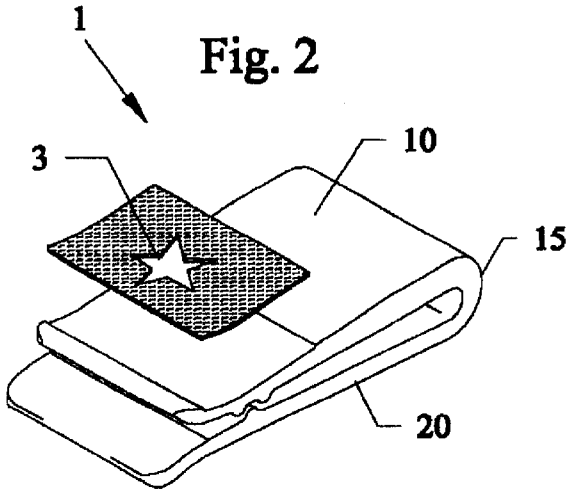
FIG. 2 shows the clip holder of FIG. 1 with indicia formed into the exterior fastener portion.
Figure 3:
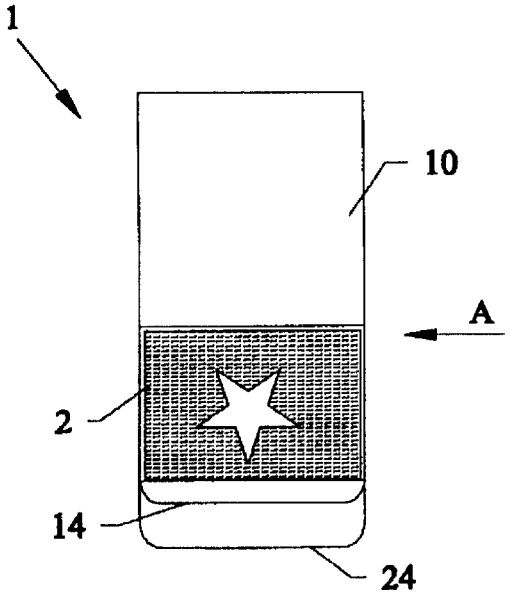
FIG. 3 shows a front view of the clip-holder of the preceding figures.
Figure 4:
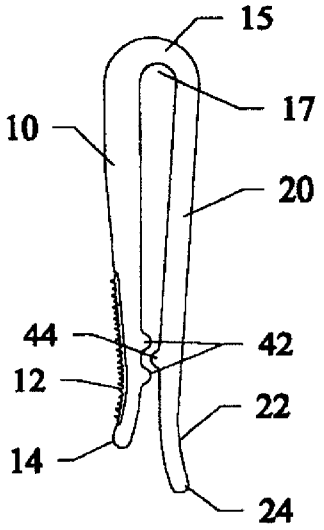
FIG. 4 shows a side view of the clip-holder of FIG. 3 along arrow A.

FIG. 1 is a perspective view of a first embodiment of the novel clip holder device 1. FIG. 2 shows the clip holder of FIG. 1 with indicia 3 formed into the exterior fastener portion 2. FIG. 3 shows a front view of the clip-holder 1 of the preceding figures. FIG. 4 shows a side view of the clip-holder 1 of FIG. 3 along arrow A.

Figure 14:
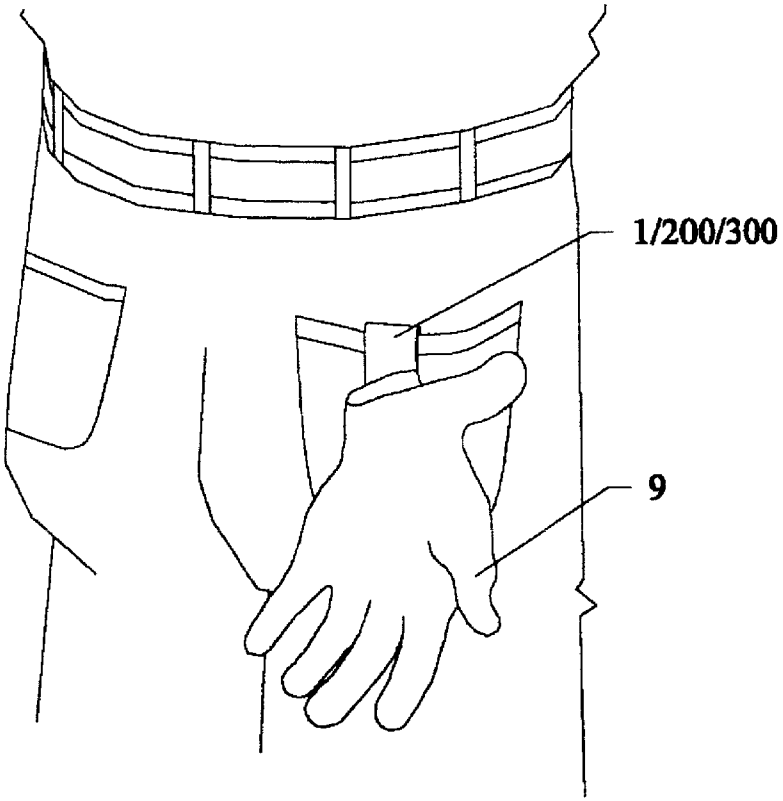
FIG. 14 shows the golf glove attached to the clip holder of FIG. 13.
Figure 13:
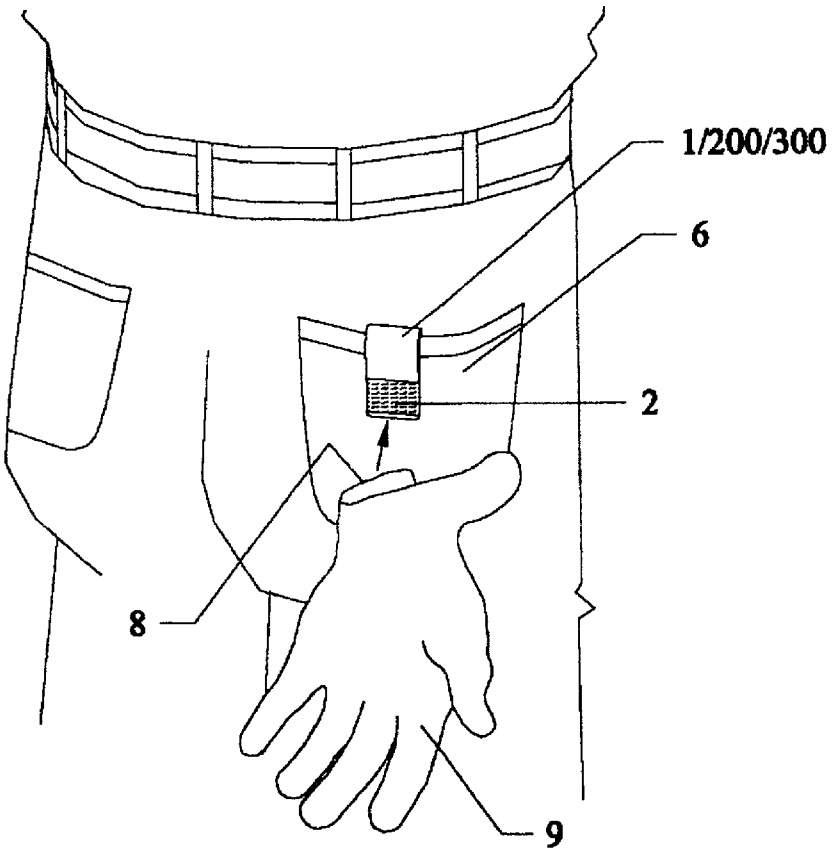
FIG. 13 shows a preferred use of attaching the clip holder of the previous embodiments onto a pant's pocket with a glove about to attached to the clip holder.

Referring to FIGS. 1–4, clip holder 1 includes a front plate-flange 10 and rear plate-flange 20 parallel to one another with a C-shaped portion connecting the plate-flanges 10, 20 together. The connecting portion 15 can have a rounded exterior surface with a rounded interior bent portion 17. Plate-flanges 10, 20 can be arranged substantially parallel to one another with the space between the plate-flanges 10, 20 larger along connecting portion 15 than the space apart from portions 12 and 22. Portions 12 and 22 can have exterior concave surfaces ending with rounded tip edges 14 and 24 facing slightly away from one another. Notably rear plate-flange 20 can be slightly longer than front plate-flange 10. Gripping portions 40 can be on interior surfaces of each of the plate-flanges 10, 20 at the point that the plate-flanges are spaced closest to one another. The gripping portions 40 can include a ridge portion 44 that fits within a slot portion 42 to cause a gripping action when attached about a pocket or belt which is shown in FIGS. 13–14. The plates-flanges 10, 20, and connecting portion 15 can be formed from a single piece injection molded plastic and the like. Alternatively, the clip holder can be formed from other materials such as but not limited to metal, aluminum, stainless steel, sterling silver, platinum, gold, a plated metal, and the like, and additionally, be painted, engraved and the like. Additionally, the surfaces or the entire clip holder 1 can be formed from rigid elastomeric type material such as rubber, and the like. The clip holder 1 can be sized to be from approximately one to approximately to approximately three inches wide, and approximately two to approximately four inches long.

A fastening means 2 such as but not limited to hook and loop fasteners(Velcro®) and the like, can be attached to a front face portion of plate-flange 10, and adhered in place by glue, self-sticking tape, and the like. Indicia 3 such as an advertising logo, can be punched into the fastening means 2, so that the under surface of the plate-flange 10.

Figure 5:
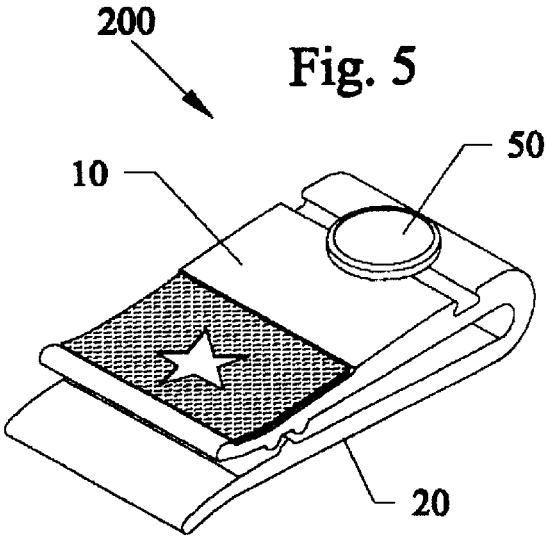
FIG. 5 is a perspective view of a second embodiment of the clip-holder with ball marker.
Figure 6:
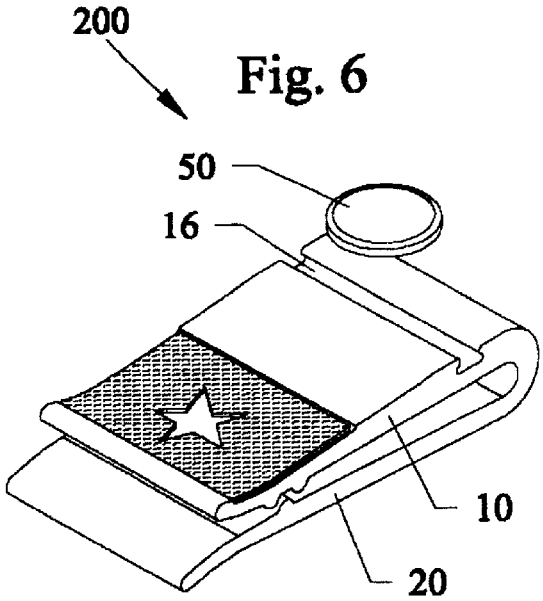
FIG. 6 shows the clip-holder of FIG. 5 with the ball marker separated from the clip holder.
Figure 7:
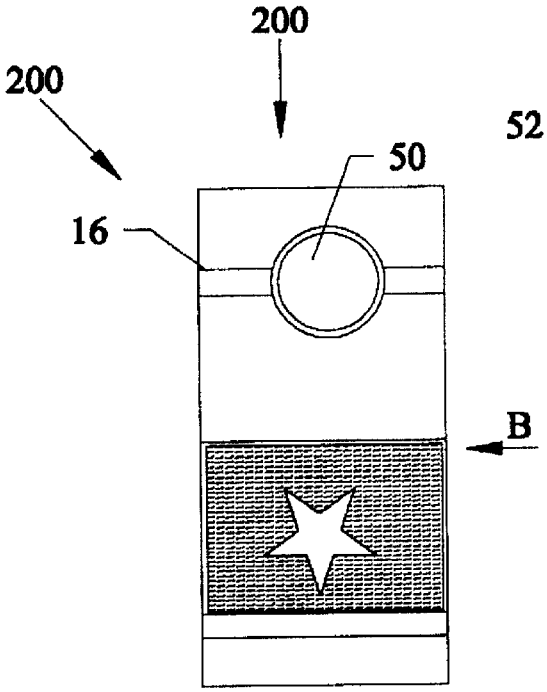
FIG. 7 is a front view of the clip holder of FIGS. 5–6.
Figure 8:
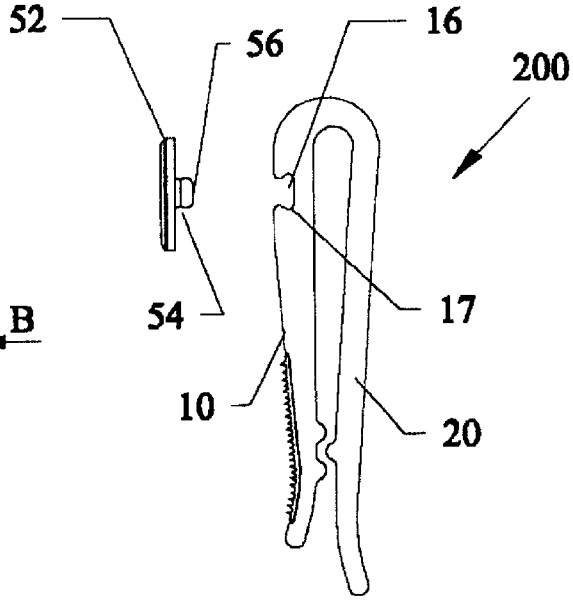
FIG. 8 shows a side view of the clip holder of FIG. 7 along arrow B.

FIG. 5 is a perspective view of a second embodiment of the clip-holder 200 with ball marker 50. FIG. 6 shows the clip-holder 200 of FIG. 5 with the ball marker separated from the clip holder. FIG. 7 is a front view of the clip holder 200 of FIGS. 5–6. FIG. 8 shows a side view of the clip holder 200 of FIG. 7 along arrow B.

Referring to FIGS. 5–8, second embodiment 200 can include similar features to the first embodiment 1 previously described, and can include a removable golf accessory tool, such as a ball marker 50. On an upper portion of front plate-flange 10 can be a horizontal slot 16 having an expanding interior portion 17 that runs horizontally from one side of plate-flange 10 to the opposite side. Ball marker 50 can include a top base portion 52 that can have a shape such as a button shape, and. he like, with a rearwardly projecting stem portion 54 and bulbous tip 56, the latter of which can be slide sideways into the horizontal slot 16 of the clip holder 200. Ball marker 50 can be used on golf courses by pressing stem portion 54 into the ground to indicate the location of a conventional golf ball. The materials that can form ball marker 50 can be similar to those previously described for clip holder 1. In addition to a horizontal slot, the clip holder 200 could have an opening through the front face of one of the plate-flanges 10, 20 to allow the stem 54 to snapably inserted into and snapably removed therefrom.

FIG. 9 is a perspective view of a third embodiment of the clip holder 300 having a built on golf tool 70 with the ball marker 50 of the preceding embodiment 200. FIG. 10 shows the clip holder 300 of claim 9 with the ball marker 50 separated from the clip holder 300. FIG. 11 is a front view of the clip holder 300 of FIGS. 9–10. FIG. 12 is a side view of the clip holder 300 of FIG. 11 along arrow C.

Referring to FIGS. 9–11, clip holder 300 includes similar features to that of the preceding embodiment 200, with the addition of a built-in golf tool 70, such as a divot repair tool. The divot repair tool 70 can include forked prong portions 72 and 76 having outwardly sides the curve inwardly to rounded tip portions 73, 77, with a space 75, having a shape, such as but not limited to a rectangle, between the prongs 72, 76. The divot repair tool can extend from downwardly up to approximately a few inches from the rear plate-flange 20, and be formed with the rear plate-flange 20.

While the third embodiment 300 shows the clip holder with both a removable ball marker and built on (fixably attached) golf tool, the invention can be used only with the built on or fixably attached golf tool.

Although, the third embodiment shows a divot type repair tool 70 as a built-in tool for the clip holder 300, other types of built-in tools can also be used. For example, the built in tool can also be a ball marker where one or more prongs 72, 75 can be used similar to the stem portion 54 of the ball marker 50 previously described.

FIG. 13 shows a preferred application of attaching the clip holder 1/200/300 of the previous embodiments onto a pant's pocket 6 with a glove 9 having a fastener portion 8, such as but not limited to hook and loop fasteners(Velcro®) about to attached to fastening portion 2 the clip holder. FIG. 14 shows the golf glove 9 attached to the clip holder 1/200/300 of FIG. 13 so that the glove 9 is located outside and not inside of the pocket 6. In FIG. 14, the gripping portions (shown more clearly in FIG. 4) grip about the flap portion of the pant's pocket 6. Due to their shape and configuration, the plate-flanges 10, 20 can slightly bend apart from one another in order to fit about and be removed from the pocket flap.

While a preferred application shows the clip holders 1/200/300 attachable and detachable from a pant's pocket, the clip holders 1/200/300 can be attachable and detachable about other pockets such as but not limited to shirt pockets, jacket pockets, and the like. Additionally, the novel clip holders 1/200/300 can be attachable and detachable about other materials such as a person's belt that is being worn, and additionally, about straps on golf type bags, and the like, as well as on other materials such as but not limited to clipboards, and any edges that can fit between the flange-plates 10, 20 of the novel clip holders 1/200/300.

Figure 15:
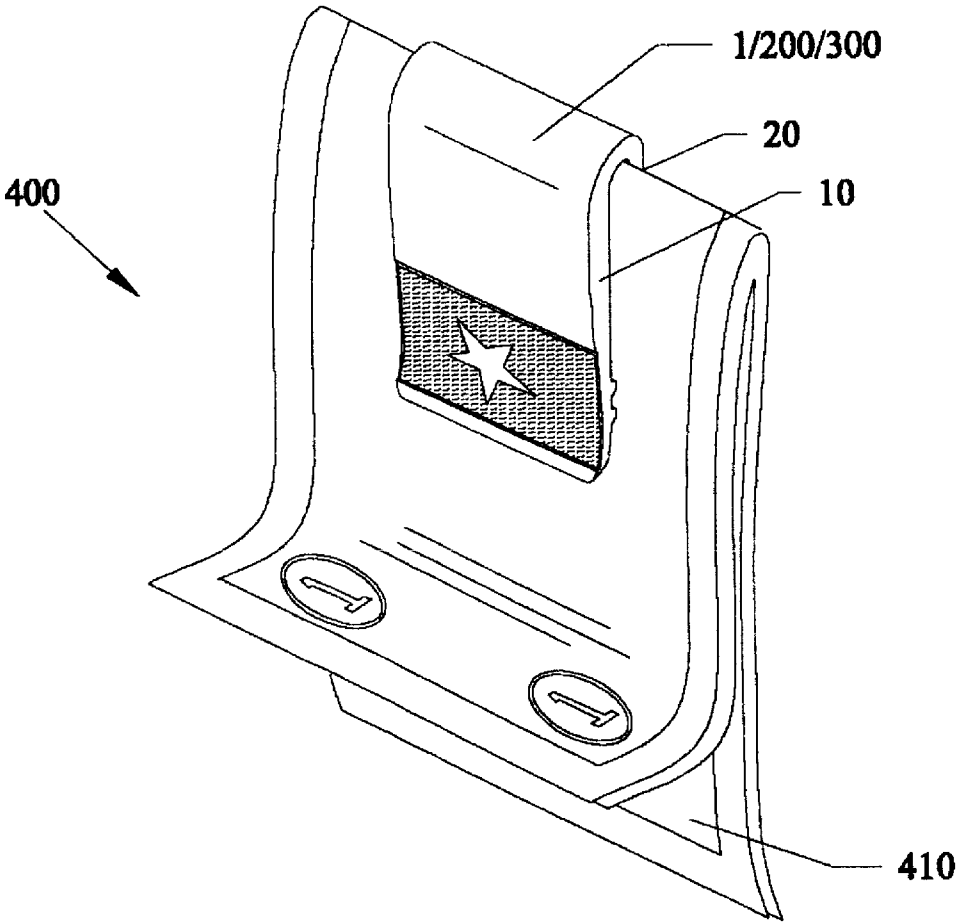
FIG. 15 is a perspective view of using one of the preceding clip holders for clipping money bills together.

FIG. 15 is a perspective view of using one of the preceding clip holders 1/200/300 as a money type clip for clipping money bills 410 such as but not limited to folded bills together, between the plate-flanges 10, 20. So that when the novel clip-holders are not being used as for golf uses, the novel clip holders 1/200/300 can have separate and dual utility for additional applications, and simply and easily be inserted inside a pocket without damaging the pocket nor causing any injury to the user.

While the preferred embodiments refer to using the clip device invention for golf type accessories and tools, the invention can be used with other types of sports accessories and tools, such as but limited to racquetball gloves, handball gloves, baseball gloves, bowling gloves, football gloves, bicycling gloves, towels, other accessories, and the like.

Although gloves having hook and loop portions are described as being supported by the clip holder, the invention can be used with other accessories such as but not limited to towels, and any other accessory that can have a mating hook and loop fastener for being attached to the clip holder.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A clip-device for supporting sports accessories onto clothing, comprising in combination:

a first flange having a first length, a first connecting end and a first concave curved end with rounded corner tip edges, with an upper exterior half portion and a lower exterior half portion;

a first hook and loop fastener only adhered onto the lower exterior half portion of the first flange adjacent to the first concave curved end;

a second flange having a second length, a second connecting end and a second concave curved end with rounded corner tip edges, the second length of the second flange being longer than the first length of the first flange, the first curved end of the first flange facing in an opposing direction from the second curved end of the second flange; and a bent edge for attaching the first connecting end to the second connecting end so that the first flange and the second flange together are in a substantially sandwich configuration forming a rigid clip;

an enlarged interior space adjacent to the bent edge between the first connecting end of the first flange and the second connecting end of the second flange;

a single gripping portion between an interior facing wall portion adjacent to the first concave end of the first flange and an opposite located interior facing wall portion on the second flange, the gripping portion consisting of only a single horizontal protruding ridge that fits within only a single horizontal slot portion, so that the second flange slides behind in a griping action about a portion of the clothing or a user, the first flange and the second flange and the bent edge and the gripping portion being molded from a single piece of plastic;

a glove having a second hook and loop fastener for being attached to the first hook and loop fastener on the first flange.

2. The clip-device of claim 1, further comprising:

a removable golf ball marker having a base and stem, the upper exterior half portion of the first flange having a horizontal slot extending from one side of the first flange to an opposite side of the first flange for receiving the stem of the ball marker.

3. The clip-device of claim 2, further comprising:

indicia punched onto a face portion of the first hook and loop fastener of the first flange, the indicia forming a selected cut-out pattern in the first hook and loop fastener.

4. A clip-device for supporting sports accessories onto clothing, comprising in combination:

a first flange having a first length, a connecting end and a first concave curved end with rounded corner tip edges, with an upper exterior half portion and a lower exterior half portion;

a first hook and loop fastener only adhered onto the lower exterior half portion of the first flange adjacent to the first concave curved end;

a second flange having a second length, a second connecting end, the second length of the second flange being longer than the first length of the first flange, the first curved end facing away from the second flange;

a bent edge for attaching the first connecting end to the second connecting end so that the first flange and the second flange are in a substantially sandwich configuration forming a rigid clip;

an enlarged interior space adjacent to the bent edge between the first connecting end of the first flange and the second connecting end of the second end of the second flange;

a single gripping portion between an interior facing wall adjacent to the first concave end of the first flange and an opposite located interior facing wall portion of the second flange, the gripping portion consisting of only a single horizontal protruding ridge that fits within only a single horizontal slot portion, so that the second flange slides behind in a gripping action about a portion of the clothing of a user, the first flange and the second flange and the bent edge of the gripping portion being molded from a single piece of plastic;

a fork shaped divot repair tool molded onto a bottom edge of the second flange, a glove having a second hook and loop fastener for being attached to the first hook and loop fastener on the first flange.

5. The clip-device of claim 4, further comprising:

a removable golf ball marker having a base and stem, the upper exterior half portion of the first flange having a horizontal slot that extends from one side of the first flange to an opposite side of the first flange for receiving the stem of the ball marker.

6. The clip-device of claim 4, further comprising:

indicia punched onto a face portion of the first hook and loop fastener of the first flange, the indicia forming a selected cut-out pattern in the first hook and loop fastener.

* * * * *